US008511598B2

(12) United States Patent
Neveu et al.

(10) Patent No.: US 8,511,598 B2
(45) **Date of Patent: *Aug. 20, 2013**

(54) SYSTEM FOR DISPENSING PAPER ROLLS WITH CONDUCTIVE TUBES

(75) Inventors: Jean-Louis Neveu, Peymeinade (FR); Gilles Cattacin, Colmar (FR)

(73) Assignee: Georgia-Pacific France, Kunheim (FR)

( * ) Notice: Subject to any disclaimer, the term of this patent is extended or adjusted under 35 U.S.C. 154(b) by 271 days.

This patent is subject to a terminal disclaimer.

(21) Appl. No.: 12/384,578

(22) Filed: Apr. 7, 2009

(65) Prior Publication Data

US 2009/0218433 A1 Sep. 3, 2009

Related U.S. Application Data

(63) Continuation of application No. 11/176,401, filed on Jul. 6, 2005, now Pat. No. 7,533,845.

(30) Foreign Application Priority Data

Jul. 6, 2004 (FR) ..... 04 07472

(51) Int. Cl.
*B65H 43/00* (2006.01)

(52) U.S. Cl.
USPC ..... 242/563; 242/564.4

(58) Field of Classification Search
USPC ..... 242/564, 564.1, 564.2, 563; 312/34.22, 312/34.8; 235/462.01, 462.13, 454, 470
See application file for complete search history.

(56) References Cited

U.S. PATENT DOCUMENTS

| | | | | |
|---|---|---|---|---|
| 1,671,724 | A | 5/1928 | Johancen et al. | |
| 3,297,269 | A | 1/1967 | McGrew | |
| 5,481,100 | A | 1/1996 | Terauchi | |
| 6,695,246 | B1 * | 2/2004 | Elliott et al. | 242/564.1 |
| 6,832,065 | B2 * | 12/2004 | Nakamura et al. | 399/286 |
| 7,018,118 | B1 * | 3/2006 | Woosley et al. | 400/242 |
| 7,040,566 | B1 | 5/2006 | Rodrian et al. | |
| 7,533,845 | B2 * | 5/2009 | Neveu et al. | 242/563 |
| 2005/0011987 | A1 * | 1/2005 | Lemaire et al. | 242/563 |
| 2005/0145745 | A1 | 7/2005 | Lewis et al. | |
| 2005/0171634 | A1 | 8/2005 | York et al. | |
| 2006/0173576 | A1 | 8/2006 | Goerg et al. | |
| 2008/0048064 | A1 | 2/2008 | Lemaire et al. | |

FOREIGN PATENT DOCUMENTS

| | | | |
|---|---|---|---|
| EP | 0401036 | A1 | 12/1990 |
| EP | 1230886 | A1 | 8/2002 |
| EP | 1231823 | A1 | 8/2002 |
| EP | 1232715 | A2 | 8/2002 |
| JP | 07010316 | A | 1/1995 |
| JP | 10262518 | A | 10/1998 |
| JP | 2004118059 | A | 4/2004 |

OTHER PUBLICATIONS

Search Report that issued Feb. 14, 2005 in FR 0407472.

* cited by examiner

*Primary Examiner* — William A Rivera
(74) *Attorney, Agent, or Firm* — Drinker Biddle & Reath LLP

(57) ABSTRACT

The invention relates to a system of dispensing a product rolled around an element such as a tube (50), such product defining a structure such as a cylinder, and such system comprising in particular: a frame, a means of support and connection of the roll in the frame. It is claimed for the invention that the tube (50) includes an electrically conductive element (50*c*) designed to operate in conjunction with an element of the frame so as together to form an electric circuit element.

23 Claims, 4 Drawing Sheets

SYSTEM FOR DISPENSING PAPER ROLLS WITH CONDUCTIVE TUBES

This application is a continuation of U.S. application Ser. No. 11/176,401, filed Jul. 6, 2005, which claims priority to French Patent Application No. 0407472, filed Jul. 6, 2004. The priorities of the foregoing applications are hereby claimed and the entirety of their disclosures incorporated herein by reference.

The invention relates to the field of single-use paper rolls used in particular by the public at large or by groups and known under designations such as toilet paper, toweling rolls, all-purpose wiping towel rolls, or hand towel rolls.

For use by groups, the product (roll) is most often placed in a dispensing device which supports and protects the roll and which performs the function of dispensing the paper. Several important functions of the dispenser include storage of paper, hygiene, and monitoring of consumption.

The dispenser and the product which it contains are often regarded as systems. They will be designated as such in what follows.

The cost of dispensers is relatively high and, except as otherwise provided, the dispenser may be suitable for several types of products. Under these conditions the commercial risk exists of having competing products offered in a dispenser that has been supplied by another dealer.

In addition, products not intended specifically for a dispenser may impair operation of this dispenser or even damage it before it has been used.

To avoid problems of this kind systems designated as "captive" have been developed so as to be suitable for only one type of product or family of expressly adapted products.

Different means are available for rendering a system "captive"; in particular, there are specially shaped plastic connectors positioned, for example, inside the roller tube on which the product is rolled, these connectors operating in conjunction with supports positioned in the dispenser. A roll cannot be mounted or cannot be used properly without these adapters. It is necessary to manufacture additional elements not of major interest to the user of the system, ones which in addition are useless once the rolled product has been completely dispensed. These plastic parts therefore represent an extra cost as well as an additional waste item that must be disposed of once the rolled product has been completely dispensed.

Rolls including necks which operate in conjunction with special supports are also known. A roll without a neck cannot be kept in the dispenser or the door of the latter cannot be closed because of the different space requirement of the roll without a neck. A neck of this type is very effective but its production requires complex conversion equipment.

Motor-powered automatic, electric, or electronic dispensers are also found, ones with bar codes read by a reading device mounted on special supports. A roll with no bar code cannot cause a motor-powered system to operate, and so the paper cannot be dispensed. Use of a bar code is highly efficient, but manufacture of the dispenser entails additional cost because of the presence of the bar code reading device.

The object of the invention is to provide a simple, cost-effective, and reliable means of making an automatic or semi-automatic dispenser, electric or electronic, for paper in rolls "captive" by using simple, conventional paper adaptation means.

Its principle is as follows. The majority of paper rolls used in dispensing machines are made by being rolled on tubes, mostly of cardboard, by rolling, superimposition, and adhesion of strips of paper.

The invention aims to optimize these tubes in order to assign an additional function in conjunction with the dispenser in which they are mounted. This function consists of providing the tube with electric conduction properties, thereby enabling this tube to perform the function of circuit breaker inside the dispenser provided for this purpose.

Consequently, the object of the invention is a system for distribution of a product rolled on an element, such as a tube, this product defining a structure such as that of a cylinder and the system in question comprising in particular:

a frame, means for support and connection of the roll inside the frame.

It is claimed for the invention that the tube comprises an electrically conductive element designed to operate in conjunction with a frame element so that the two together make up an element of an electric circuit.

The invention relates preferably to the electrically "conductive" function assigned to the tube.

Consequently, the current-conducting element may consist of a layer of conductive material in contact with all or part of the interior and/or exterior surface of the tube.

Specifically, the conductive layer in question may be of a thickness ranging from a few microns to around 1 millimeter.

The invention is suitable for being applied in various technical solutions.

In a preferred embodiment of the invention, the tube is made up of a cardboard cylinder coated on the inside with a layer of conductive material, such as copper or aluminum.

Consequently, the layer of conductive material may consist of a strip of metal glued to the surface of the cardboard cylinder in question.

In another embodiment of the invention the conductive element consists of a network of metal wires woven or knitted together.

The conductive wires preferably may have a diameter of the order of 50 microns.

Without departing from the scope of the invention, the conductive element may comprise a network of interwoven polymers or elastomers to which are applied conductive elements, such as carbon, silver, nickel, copper, or aluminum.

In another embodiment of the invention, the conductive element consists of a layer of conductive material made up of a coat of paint or ink including conductive particles (or charges).

In addition, the system claimed for the invention comprises at least one element the purpose of which is to ensure electric connection of the tube and the frame. This element may be in the form of a connector having a conductive contact force fitted into one end of the tube.

The invention also relates to a conductive tube to be used in a roll dispensing system.

Other features, details, and advantages of the invention are presented in the following description by way of non-restrictive illustration with reference to the drawings, in which.

Figure 3A:
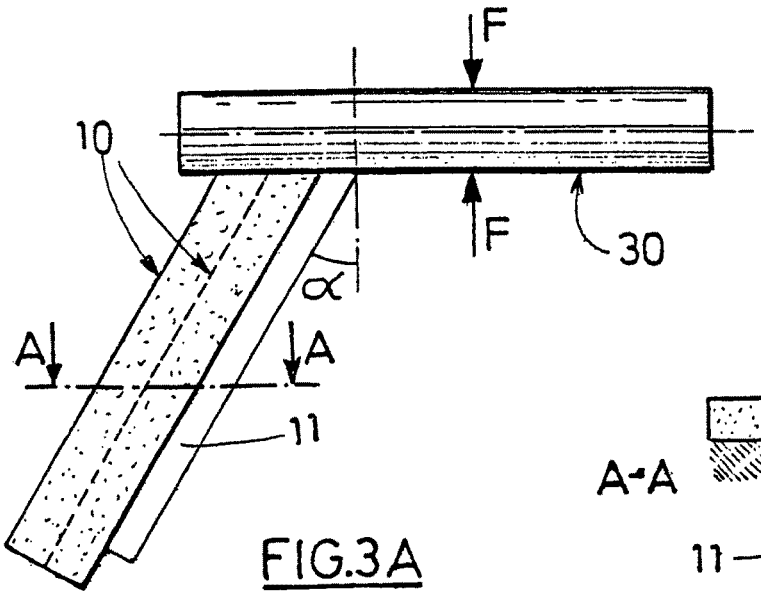
FIG. 3A is a diagram illustrating the forming of a tube as claimed for the invention by rolling.
Figure 3B:
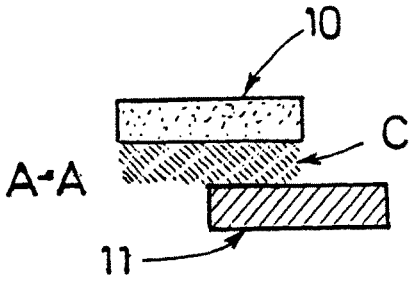
Figure 4:
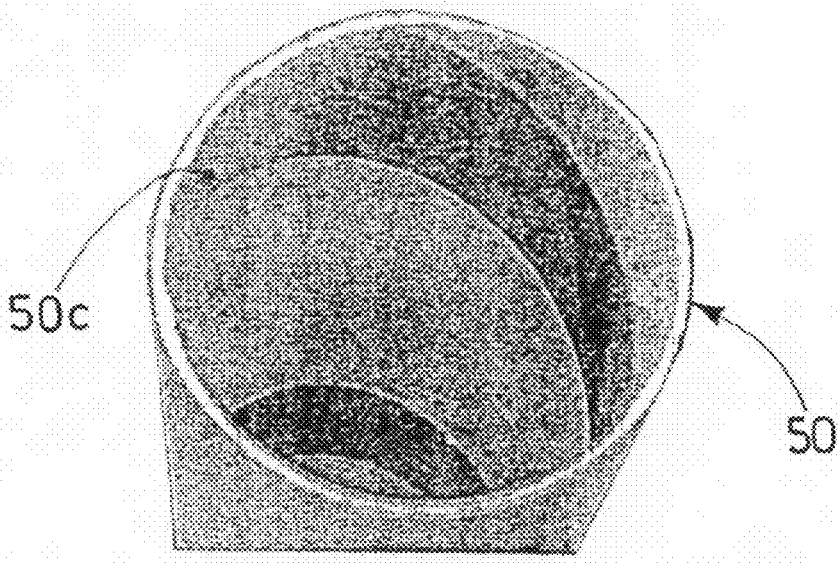
Figure 5:
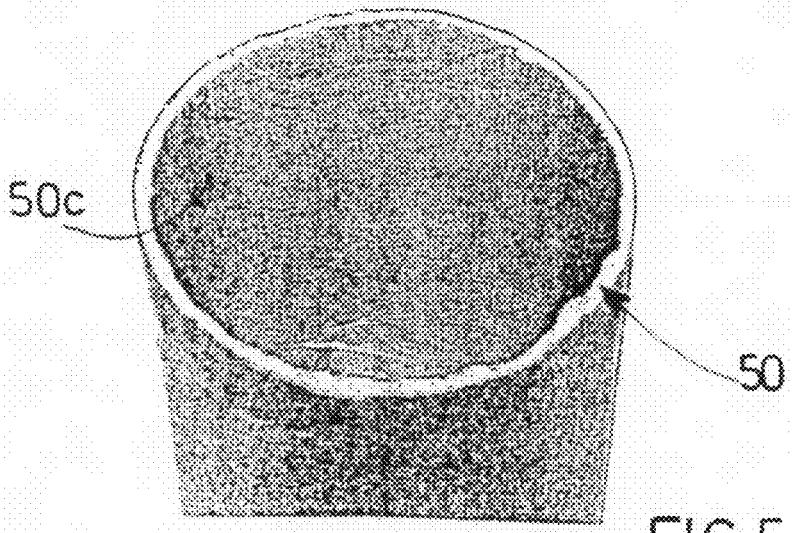
Figure 6:
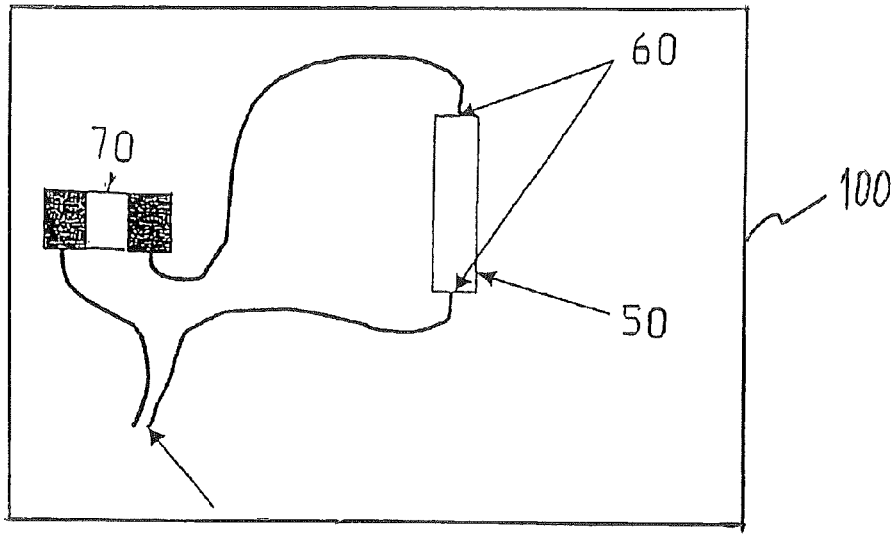
Figure 7A:
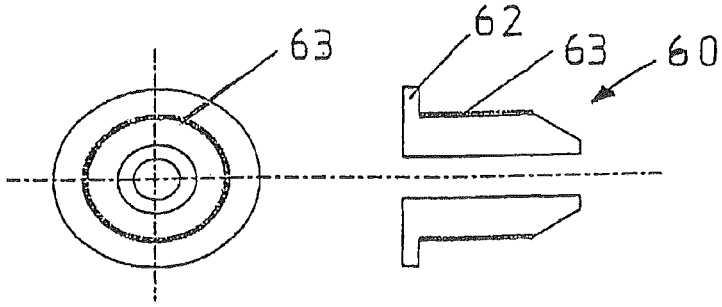
Figure 7B:
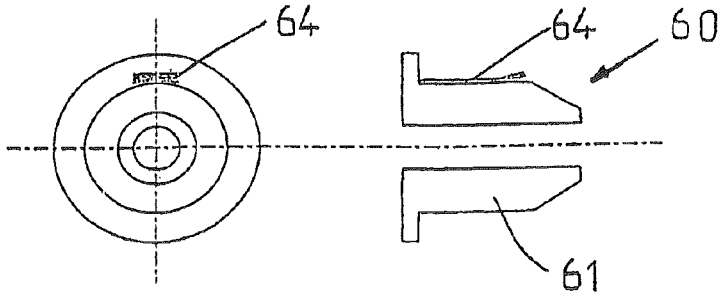

FIG. 3B a simplified section of the thickness of a tube claimed for the invention;

FIG. 4 is a photograph of the interior of a tube partly coated with a conductive strip;

FIG. 5 is a photograph of the interior of a tube coated in its entirety with a conductive strip;

FIG. 6 is a flow chart of an electric circuit of a dispenser comprising a tube as claimed for the invention;

FIG. 7A is made up respectively of a cross-section and a longitudinal section of a first embodiment of a dispenser projection, and FIG. 7B is made up respectively of a cross-section and a longitudinal section of a second embodiment of a dispenser projection.

Figure 1:
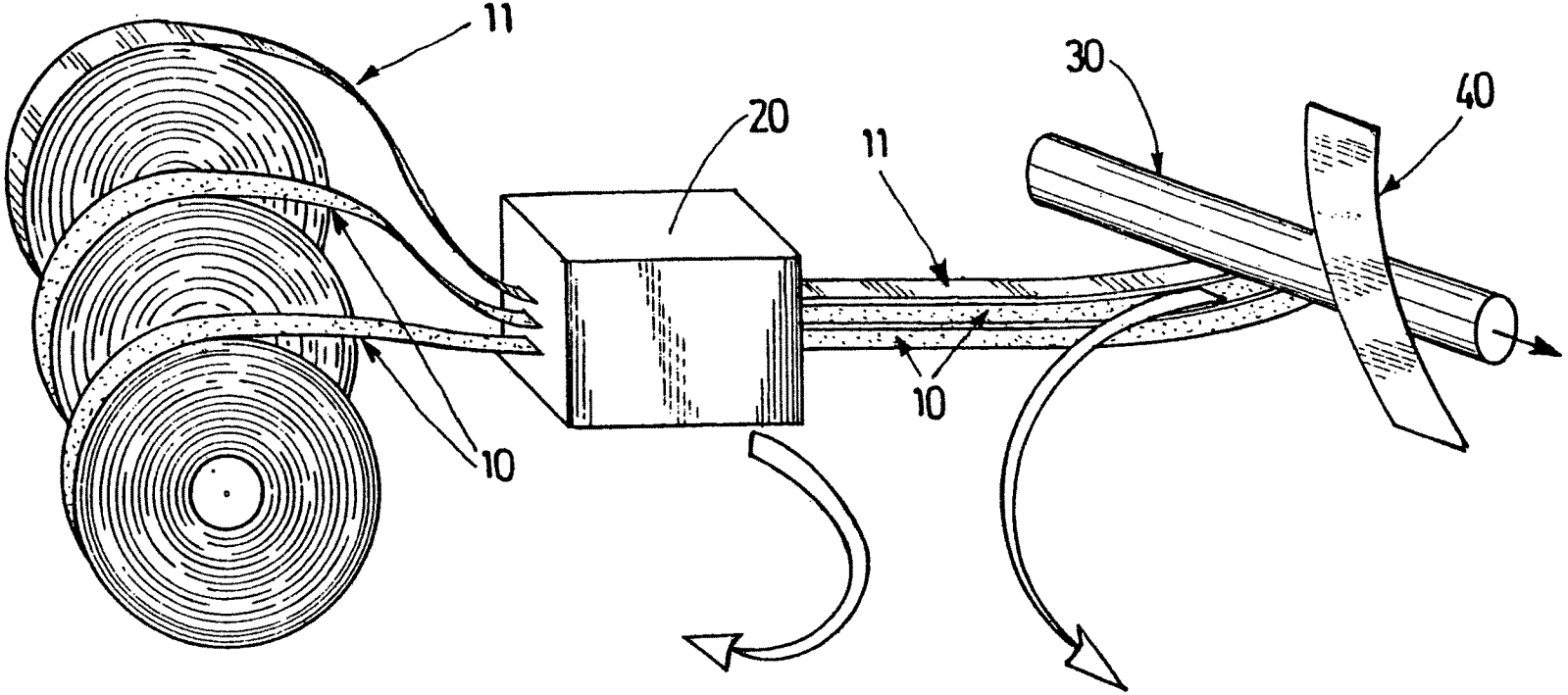
FIG. 1 is a diagram of equipment for production of conductive tubes as claimed for the invention.

Thus, FIG. 1 illustrates a tube production assembly intended specifically for the dispensing system claimed for the invention. More specifically, FIG. 1 relates to one embodiment of such a tube.

One or more strips 10 of cardboard are unrolled from one or more spools (not identified by reference numbers) simultaneously with a strip of conductive material 11. The latter may be intrinsically conductive or may be coated with a conductive material.

For example, aluminum, copper, nickel, among others, are to be selected as conductive materials.

The strips 10 make it possible to rigidify the tube ultimately obtained and to impart a certain thickness to it.

Figure 2:
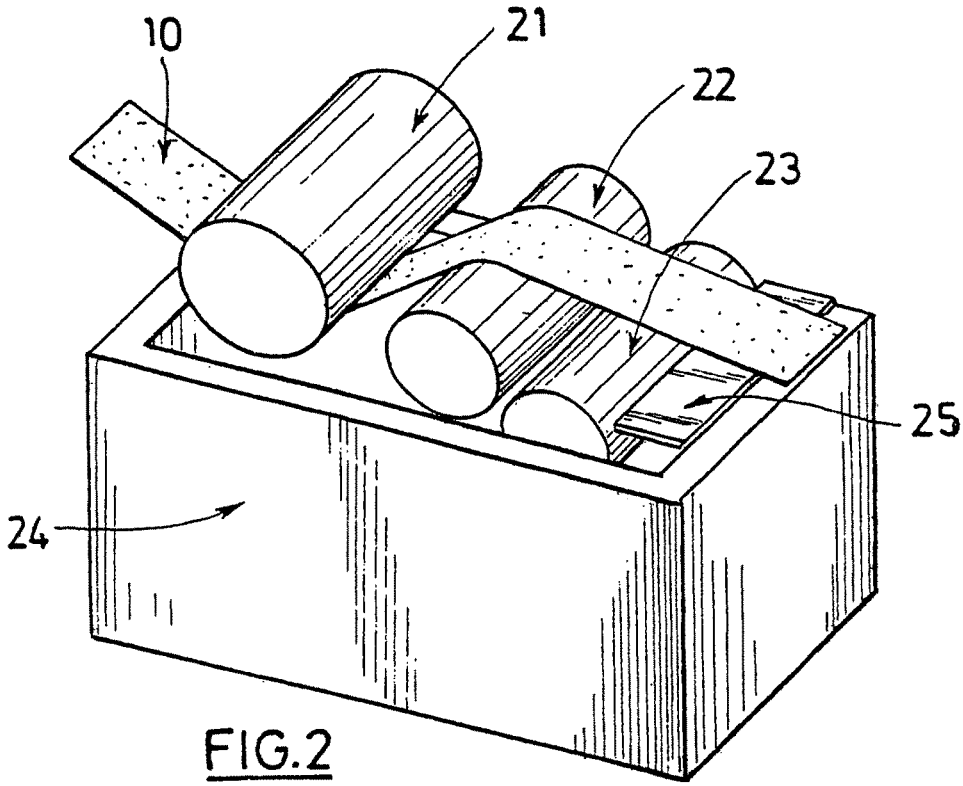
FIG. 2 is a diagram illustrating a means of forming a tube by adhesion in one embodiment of the invention.

The different strips 10, 11 are taken to a gluing station 20, an exemplary embodiment of which is illustrated in greater detail in FIG. 2.

At the outlet of the gluing unit the strips, 10, 111 are positioned so as to be side by side in the same horizontal plane and while in this position are taken to a spindle 30 on which they are rolled simultaneously as is explained below in connection with FIGS. 3A and 3B.

A drive belt 40 ensures guiding of the strips 10, 11 around the spindle 30 as well as securing of these strips against it in order to ensure cohesion of the strips to each other and shaping of the strips.

Once they have been brought together at the level of the spindle 30 the strips 10, 11 form a cylinder, or hollow tube, preferably provided on the inside with a conductive layer.

FIG. 2 presents an example of a means 20 of gluing at least one of the strips 10, 11.

The means is itself known, so that only a brief description of it will be given here.

The strip 10 to be glued comes to a first cylinder 21 serving to tighten and guide the strip.

The strip 10 then comes in contact with a second cylinder 22 serving to transfer glue. A third cylinder 23 positioned downstream from the second cylinder 22 in the direction of advance of the strip 10 provides for application of glue to the second cylinder 22.

The three cylinders 21, 22, 23 have parallel axes perpendicular to the direction of advance of the strip at the level of the gluing means 20.

A tank 24 positioned below the cylinders contains the glue.

A scraping knife 25 or any other means permitting control and limiting of the amount of glue is provided, preferably near the outlet end of the strip.

Other ways of depositing glue on one of the strips 10, 11 may, of course, be considered without going beyond the framework of the invention; nozzles may also be used to project glue onto the strip or strips. A glue of the hot-melt type may be provided, or a two-sided adhesive strip (pre-glued), may be brought into contact with at least one of the strips 10 making up the rigid structure of the finished tube.

FIG. 3A presents a top view of a diagram of the process of winding of the strips 10, 11 around the spindle 30.

Conventionally the strips 10, 11 arrive at an angle $\alpha$ of a value other than zero relative to the plane perpendicular to the axis of the spindle. They are pulled around the spindle 30 by the belt 40.

Spiral (or helicoidal) winding of the strips 10, 11 around the spindle 30 is thereby effected, with for greater or lesser coverage.

FIG. 3B section AA (derived from FIG. 3A) shows the arrangement of the strips. A layer of glue C is deposited on the exterior of the (cardboard) strip 10 to ensure joining to the internal conductive strip 11. Strips 10, 11 are laterally displaced.

Arrows F in FIG. 3A indicate the force of clamping of the belt 40; as has already been pointed out, this force ensures good joining and cohesion of the strips 10, 11 to each other.

After several turns around the spindle 30, the two strips 10, 11 joined to each other form a conductive cylinder which is then cut into individual conductive tubes 50, such as those shown as examples in the photographs in FIGS. 4 and 5.

In FIG. 4, the tube 50 is partly coated on the inside with a conductive layer 50*c* made up of the strip 11 in the embodiment described in the foregoing.

In FIG. 5, the interior surface of the conductive tube 50 is covered in its entirety—with a layer of conductive material 50*c*.

It is to be pointed out by way of illustration that this conductive layer may be of a thickness ranging from a few microns (around 10) to around 1 millimeter.

The structure 10 which ensures rigidity of the tube 50 may be of a thickness of around 1 millimeter to around 3 millimeters.

The conductive layer 50*c* may be positioned on the inner and/or outer structural layers and/or inserted between the structural layers (such as those of cardboard 10) of each tube.

The width of the conductive strip 50*c* may or may not equal that of the strips 10.

Preference is to be given to the embodiment described in the foregoing especially in terms of cost, since it suffices to add a conductive strip 11, for example, in place of an existing non-conductive strip, to the inlet of a conventional tube production assembly.

Other embodiments of the invention, ones also marked by high efficiency, may be obtained without going beyond the framework of the invention.

In particular, the conductive element may consist of a network of conductive wires interconnected by weaving or knitting.

The network of conductive wires and/or fibers may also be combined to form a "non-woven" structure. Non-woven is here understood to mean an array of wires and/or fibers assembled so as to form a bundle whose weight may range from approximately 35 to 50 grams per square meter.

A "wire" is of a length of a few centimeters to several meters or even several hundred meters, while a "fiber" may be of a length of several millimeters to around 100 millimeters. These lengths are obviously given only by way of illustration for the purpose of clarifying the different terms used.

The wires, for example, may be of nickel and have a diameter of around 50 microns.

The layer or coat thereby formed is associated with a rigid structural element by any known method, such as by lining as specified in the foregoing with reference to FIG. 1.

Another embodiment of the conductive tube 50 claimed for the invention may consist of producing a conductive element 50*c* by applying a coat of paint or ink specifically containing conductive particles.

It is possible, for example, to produce a layer of polymers or elastomers charged with particles of silver, nickel, or carbon by extrusion, coating, or another known process.

The particles currently are of a diameter of the order of a few millimeters, while the layer may be of a thickness of a few microns to 1 millimeter.

The electrically conductive tubes produced in this manner are designed to be incorporated into motor-driven automatic or semi-automatic electronic or electric dispensers. The modifications needed for such dispensers to enable them to operate with tubes of this type are minimal. In effect, it suffices to modify the electric system so as to have an open circuit when such a tube is absent and a closed circuit when a tube is present.

Hence it is to be seen that the conductive tube in this instance performs the function of a "circuit breaker".

FIG. 6 illustrates the principle of operation of a dispenser 100 claimed for the invention. The conductive tube 50 is brought into contact with two connectors 60 provided with contactors. Electric power may come from a battery 70 or a power grid. This energy source controls the dispenser for performance of operations such as automatic paper feed, detection of jamming, and so forth.

A known automatic dispenser is described, for example, in patent applications EP 1 232 715, EP 1 231 823, EP 1 230 886.

Dispensers of this type comprise a frame the purpose of which is to hold and place in position one or more rolls of paper, means of dispensing the roll or rolls of paper, and means for control of the dispensing means. Such control means react to electric sensors. For example, proximity sensors designed to detect the presence of a user in the vicinity of the dispenser make it possible to dispense a specific length of paper.

A roll with conductive tube, such as that described in the foregoing, is particularly well suited for such dispensers.

Connecting elements are needed in order to effect contact adaptation of rolls such as are described in the foregoing in an automatic dispenser of this type.

FIGS. 7A and 7B are cross-sections and longitudinal sections respectively of connectors 60 capable of operation in conjunction with and of coming in contact with the conductive tube 50.

Each connector has a cylindrical area 61 designed to be brought into contact with the inner wall of the tube 50, as well as an end cap 62 which rests against one of the ends of the tube.

The connector 60 preferably is force-fitted into the tube 50.

As is to be seen in FIG. 7A, the cylindrical area 61 of the connector 60 is covered externally by a conductive cylinder 63 which, when the connector 60 is positioned at one of the ends of the tube 50, comes in contact with its inner surface, thereby closing the electric control circuit as shown in diagram form in FIG. 6.

In the embodiment shown in FIG. 7B the cylindrical area 61 of the connector 60 is partially covered by a contactor 64.

Another possible embodiment of the conductive element (SOc) may consist of a wire element joined by any known means to the rigid structure 10 of the tube, the wire element being positioned so as to come in contact with the contact elements 64 of the electric circuit of the dispenser.

It is to be understood that other types of connecting elements and/or conductive elements may be considered without departing from the scope and spirit of the invention.

As our invention, we claim:

1. A method to control operation of a dispenser configured to dispense product, the method comprising:

providing a tubular element that comprises an electrically conductive element to form a hollow electrically conductive tube configured to form a circuit breaker component for a dispenser operation electrical circuit associated with a dispenser;

configuring the electrically conductive element to control the dispenser operation electrical circuit such that placement of the tubular element in a first position relative to the dispenser completes the dispenser operation electrical circuit by forming a closed electrical path and placement of the tubular element in a second position relative to the dispenser breaks the dispenser operation electrical circuit.

2. The method of claim 1, wherein the electrically conductive element comprises a layer of conductive paint or ink material including conductive particles.

3. The method of claim 2, further comprising providing the layer with a thickness in a range of from about 10 microns to about 1 millimeter.

4. The method of claim 1, further comprising providing the electrically conductive element with a layer of conductive material in contact with at least part of at least one of an inner surface and an outer surface of the cylindrical element.

5. The method of claim 1, further comprising providing the tubular element with a lining of conductive material on an interior surface of the cylindrical element.

6. The method of claim 1, further comprising providing the electrically conductive element as a network of metal wires woven or knitted together.

7. The method of claim 1, further comprising providing the electrically conductive element as polymeric or elastomeric material charged with one or more conductive elements.

8. The method of claim 1, further comprising providing at least one connector element to electrically connect the tubular element and a frame forming part of the dispenser.

9. The method of claim 8, wherein the at least one connector element comprises a connector having a conductive contact inserted into one end of the tubular element.

10. The method of claim 1, further comprising providing the electrically conductive element as an elongated element having ends located proximate opposing ends of the tubular element.

11. A method to control operations of a dispenser, the method comprising:

configuring a dispenser to carry a cylindrical element configured to hold a roll of sheet product sized and shaped for disposition within the dispenser; and providing the cylindrical element with an electrically conductive element to form a hollow electrically conductive tube that is configured to operate in conjunction with the dispenser to form an electric circuit element of an electrical circuit to form a closed electrical path that provides power to the dispenser for dispensing product from the dispenser when power is provided to the electrical circuit.

12. The method of claim 11, wherein the electrically conductive element is disposed on at least one of an interior or exterior surface of the cylindrical element.

13. The method of claim 11, further comprising providing at least one connector element to provide electrical connection between the cylindrical element and a frame of the dispenser.

14. The method of claim 11, wherein the electrically conductive element comprises a metal strip adhered to a surface of the cylindrical element.

15. The method of claim 11, further comprising configuring the cylindrical element such that upon removal of the cylindrical element from the dispenser, the electrical circuit that provides power to the dispenser is broken.

16. The method of claim 11, further comprising providing the electrically conductive element as conductive ink, conductive powder, or conductive paint.

17. The method of claim 11, further comprising configuring the conductive element to activate the dispenser by completing the electrical circuit that provides power to the dispenser and to deactivate the dispenser by breaking the electrical circuit that provides power to the dispenser.

18. A method to control operation of a dispenser configured to dispense product, the method comprising:

configuring a cylindrical element to carry a roll of sheet product to be dispensed from the dispenser; and positioning an electrically conductive component proximate the cylindrical element and within the dispenser, the electrically conductive component being disposed relative to the cylindrical element to form a hollow electrically conductive tube, wherein the electrically conductive component is configured as a circuit breaker component to complete a dispenser electrical power circuit to form a closed electrical path for operating the dispenser enabling product to be dispensed from the dispenser.

19. The method of claim 18, further comprising configuring the electrically conductive component as a layer of conductive material disposed on the cylindrical element.

20. The method of claim 18, wherein the electrically conductive component comprises at least one of conductive ink, conductive powder, and conductive paint.

21. A method to control operation of a dispenser, the method comprising:

configuring a dispenser to carry a cylindrical element configured to hold sheet product to be dispensed from the dispenser; and configuring the dispenser to interface with an electrically conductive element associated with the cylindrical element, the electrically conductive element being disposed relative to the cylindrical element to form a hollow electrically conductive tube, wherein the electrically conductive element operates in conjunction with the dispenser to form an electric circuit breaker element of a dispenser electrical power circuit to form a closed electrical path that provides power to the dispenser and enables sheet product to be dispensed from the dispenser when power is provided to the circuit.

22. The method of claim 21, wherein the electrically conductive element comprises at least one of conductive ink, conductive powder, and conductive paint.

23. The method of claim 21, further comprising configuring the dispenser to interface with the electrically conductive element such that when the electrically conductive element is in a first position, power is provided to the dispenser and when the electrically conductive element is in a second position, no power is provided to the dispenser.

* * * * *